US009155432B2

(12) United States Patent
Cunningham et al.

(10) Patent No.: US 9,155,432 B2
(45) Date of Patent: Oct. 13, 2015

(54) CENTRAL VACUUM CONTROL UNIT

(75) Inventors: J. Vern Cunningham, Aurora (CA); Mircea Dan Paul, Richmond Hill (CA); Daniel Budurea, Mississauga (CA)

(73) Assignee: CUBE INVESTMENTS LIMITED, Auror, ON (CA)

( * ) Notice: Subject to any disclaimer, the term of this patent is extended or adjusted under 35 U.S.C. 154(b) by 471 days.

(21) Appl. No.: 13/505,207

(22) PCT Filed: Oct. 26, 2010

(86) PCT No.: PCT/CA2010/001671

§ 371 (c)(1),
(2), (4) Date: Apr. 30, 2012

(87) PCT Pub. No.: WO2011/050449

PCT Pub. Date: May 5, 2011

(65) Prior Publication Data

US 2012/0216362 A1 Aug. 30, 2012

Related U.S. Application Data

(60) Provisional application No. 61/256,708, filed on Oct. 30, 2009.

(51) Int. Cl.

| | |
|---|---|
| ***A47L 5/38*** | (2006.01) |
| ***A47L 5/12*** | (2006.01) |
| ***A47L 9/28*** | (2006.01) |

(52) U.S. Cl.

CPC ... *A47L 5/38* (2013.01); *A47L 5/12* (2013.01); *A47L 9/2842* (2013.01); *A47L 9/2857* (2013.01); *A47L 9/2894* (2013.01)

(58) Field of Classification Search

CPC ..... A47L 5/38; A47L 9/28; A47L 5/12; A47L 9/2842; A47L 9/2857; B08B 15/002; B65H 2701/33; D01H 11/005; B23Q 11/0046

USPC ..... 15/301–319, 413

See application file for complete search history.

(56) References Cited

U.S. PATENT DOCUMENTS

| | | | | |
|---|---|---|---|---|
| 5,422,787 | A * | 6/1995 | Gourdine | 361/697 |
| 5,924,164 | A | 7/1999 | Lindsay, Jr. | |
| 2007/0079468 | A1 | 4/2007 | Cunningham et al. | |
| 2007/0079469 | A1 * | 4/2007 | Cunningham | 15/319 |
| 2007/0283521 | A1 | 12/2007 | Foster et al. | |

* cited by examiner

*Primary Examiner* — Robert Scruggs

(57) ABSTRACT

A central vacuum cleaning system can include a vacuum unit, a plurality of inlet valves, an exhaust, a cleaning air path from the inlet valves through the vacuum unit to the exhaust, and a control unit. An example control unit can include a power input, a power output, motor control circuitry to control application of power from the power input to the power output, a first port, a second port, a conduit providing a conduit air path between the first port and the second, a heat sink in thermal contact with the conduit air path and a component of the motor control circuitry, wherein the control unit is connected through the first port and the second port in the cleaning air flow path between the inlets and the exhaust, and the power output is connected to a power input of the vacuum unit.

18 Claims, 7 Drawing Sheets

CENTRAL VACUUM CONTROL UNIT

CROSS-REFERENCE TO OTHER APPLICATIONS

This application claims priority from and the benefit of the filing date of U.S. Provisional Patent Application 61/256,708 filed Oct. 30, 2009 under title CENTRAL VACUUM CONTROL UNIT. The content of the above application is hereby incorporated by reference into the detailed description hereof.

FIELD

This description is related to the general field of central vacuum system components.

BACKGROUND

Many modern buildings have central vacuum cleaning systems. These systems have a vacuum unit incorporating a suction motor and impeller to create a vacuum in piping through the building. A user of the system connects a flexible hose to the piping. The hose has a handle for the operator to grasp. The handle is further connected to one or more cleaning accessories.

The motor is housed in a motor housing that typically forms part of a central vacuum unit, often referred to as a "central vacuum power unit". The vacuum unit also has a receptacle portion for receiving dust and other particles picked up through the cleaning accessories and transported by airflow generated by the vacuum unit through the hose and piping.

The vacuum unit is usually placed in a central location that is easily accessible for emptying the receptacle. The motor is typically powered by line voltage that is controlled by a motor control circuit in the motor housing.

Low voltage wires typically run beside, or form part of, the piping and hose between the canister and the handle. This permits the operator to control the motor by sending low voltage signals from the handle to the motor control circuit. In order to receive the low voltage signals, an opening is provided in the motor housing through which the low voltage wires can be connected to the motor control circuit.

Improvements to, or alternatives for, components in central vacuum cleaner systems, and methods related thereto, are desirable.

BRIEF DESCRIPTION OF DRAWINGS

For a better understanding of the present embodiments and to show more clearly how the embodiments may be carried into effect, reference will now be made, by way of example, to the accompanying drawings that show the preferred embodiment of the present invention and in which.

DETAILED DESCRIPTION

Figure 1:
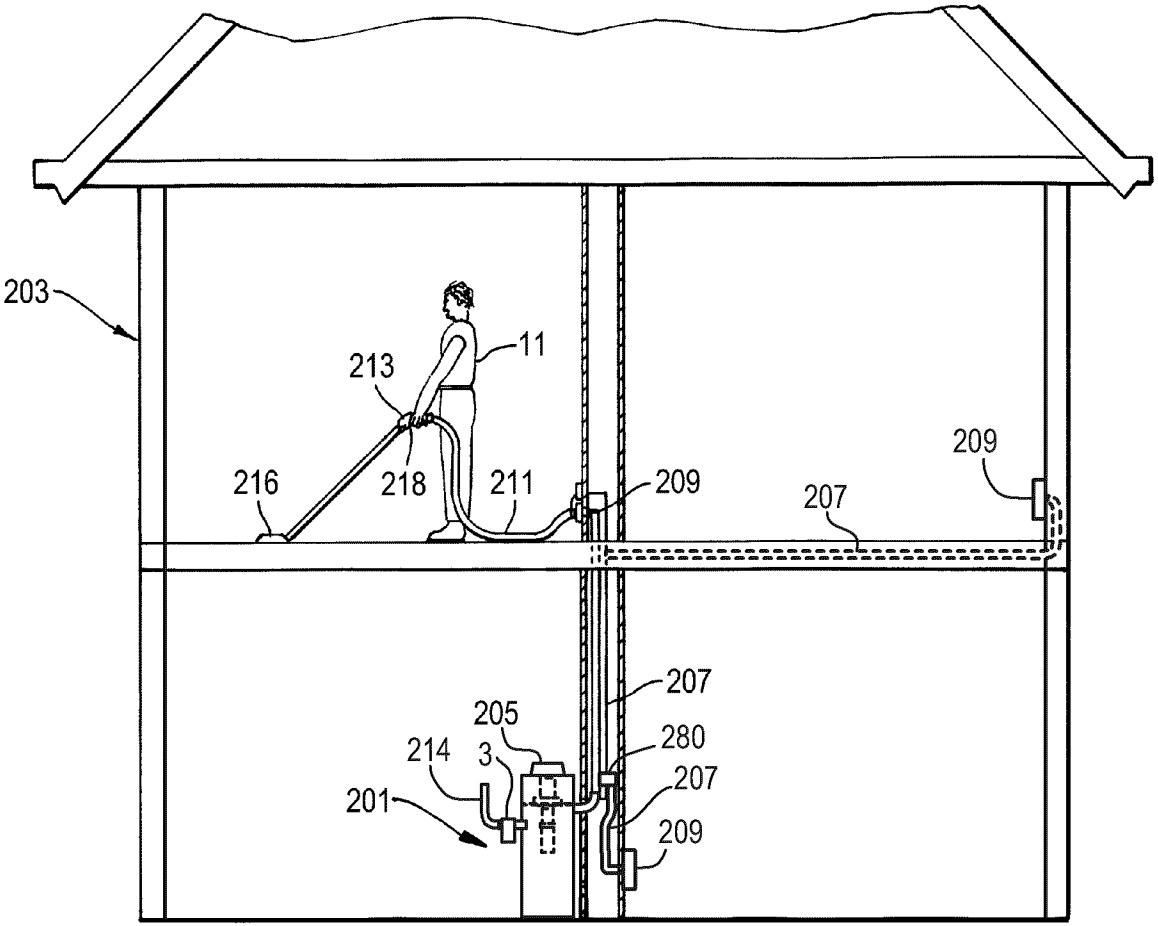
FIG. 1 is a cross-section of a building incorporating an example implementation of a central vacuum cleaning system.

It is to be noted that numerous components are similar for different embodiments described herein, and components from one embodiment can be used on other embodiments. The description for similar components in different embodiments applies equally to all embodiments unless the context specifically requires otherwise. Components from one embodiment can be applied to other embodiments unless the context specifically requires otherwise, and specific reference to the cross-application of such components will not be made for each embodiment, but is expressly stated hereby.

Terms of orientation, such as top, bottom, front, rear, side, are used in the description. Terms of orientation are used for ease of understanding of the concepts being described. It is understood that in practice the structures described herein can take on alternate orientations.

Various example aspects and various example implementations of aspects of central vacuum cleaning system and elements of such systems will be described herein. For example an example central vacuum cleaning system can include a vacuum unit, a plurality of inlet valves, an exhaust, a cleaning air path from the inlet valves through the vacuum unit to the exhaust, and a control unit. An example control unit can include a power input, a power output, motor control circuitry to control application of power from the power input to the power output, a first port, a second port, a conduit providing a conduit air path between the first port and the second, a heat sink in thermal contact with the conduit air path and a component of the motor control circuitry, wherein the control unit is connected through the first port and the second port in the cleaning air flow path between one of the plurality of inlet valves and the exhaust, and the power output is connected to a power input of the vacuum unit.

The control unit can be connected in the cleaning air path between the vacuum unit and the inlet valves in air flow communication with all inlet valves. The control unit can be connected in the cleaning air path between the vacuum unit and the exhaust.

The system can have central vacuum cleaning system piping between the inlet valves and the vacuum unit, and between the vacuum unit and the exhaust. The piping can provide a portion of the cleaning air path, and the first port and second port can be piping ports connected to the piping.

In operation, an example implementation can provide cooling of motor control circuitry in a central vacuum cleaning system by generating a vacuum to create air flow in a cleaning air path from one of a plurality of inlet valves through a vacuum unit to an exhaust, wherein the cleaning air path includes a control unit connected between one of the plurality of inlet valves and the exhaust and the control unit including a power input, a power output, motor control circuitry to control application of power from the power input to the power output, a first port, a second port, a conduit providing a conduit air path between the first port and the second, a heat sink in thermal contact with the conduit air path and a component of the motor control circuitry.

Other aspects and implementations of aspects will be evident from the detailed description herein.

Referring to FIG. 1, a central vacuum cleaning system (indicated generally at 201) incorporates a control unit 3. The system 201 is installed in a building 203. The building 203 is shown as a residence; however, the system 201 could be installed in other buildings, such as commercial or industrial buildings.

The system 201 has a vacuum unit 205 in the building 203. The vacuum unit 205 is connected through piping 207 in walls, floors or ceilings of the building 203. Alternatively, the piping 207 may be exposed. The piping 207 terminates at inlet valves 209 to which a flexible hose 211 may be connected. The hose 211 terminates in a handle 213 that is held by an operator 11. Various cleaning attachments, such as a carpet brush 216, are connected to the handle 213.

Control signals, such as ON/OFF, from the operator 11 to the control unit 3 are provided through a user interface 218 in the handle 213. The user interface 218 can be a simple switch. More sophisticated systems 201 can utilize more sophisticated control signals for many other purposes, such as duplex communications that allow the receipt of information at the handle 213. Such information could be used to drive LEDs, an LCD screen, or other display means as part of the user interface 218.

When the operator 11 turns on the system 201, a vacuum created by the vacuum unit 205 draws cleaning air through a cleaning air path including the attachment 216, handle 213, hose 211, piping 207, the vacuum unit 205, and exhausts the cleaning air to the environment through exhaust 214. The exhaust 214 may terminate inside or outside the building 203. The exhaust 214 can include a muffler, not shown, to dampen noise. The exhaust 214 can include a terminating vent, not shown, for outdoor termination applications.

Figure 2:
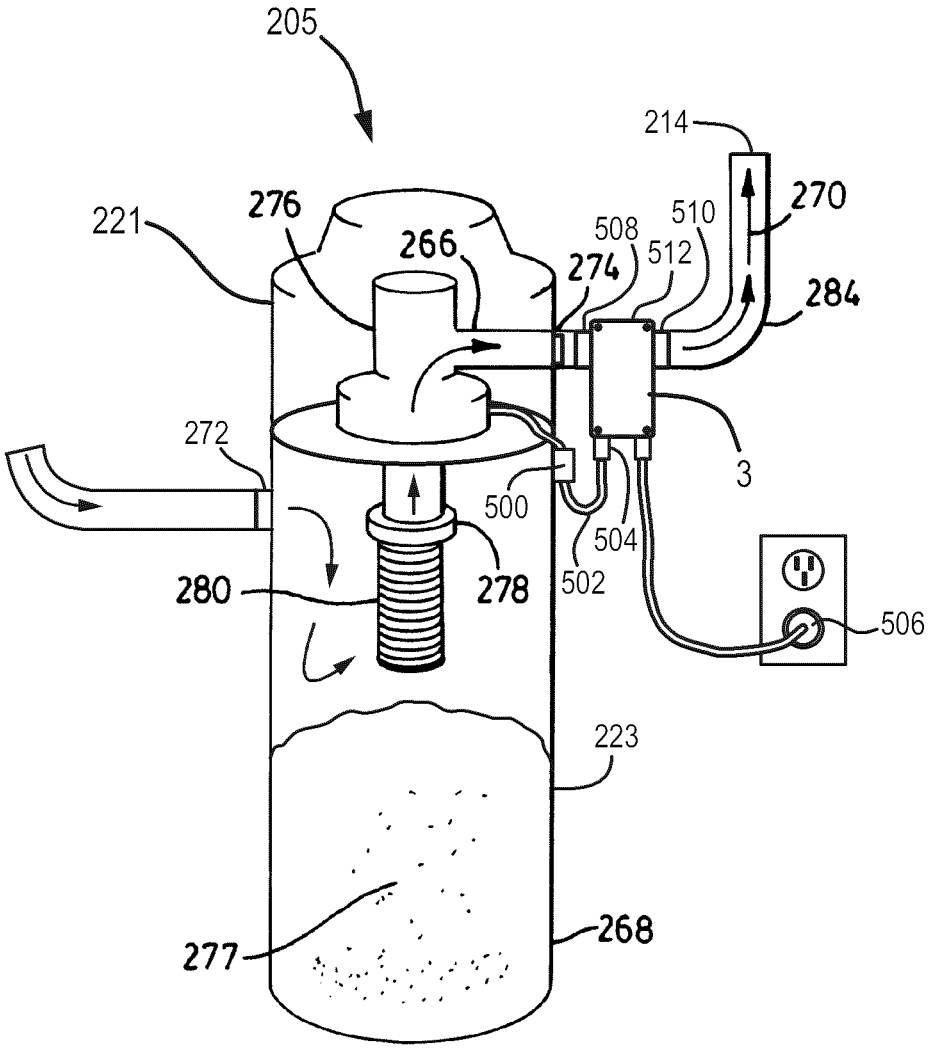
FIG. 2 is a perspective view of an example implementation of a vacuum unit and control unit assembly for use in the cleaning system of FIG. 1, the assembly incorporating an example implementation of a control unit and the vacuum unit shown in partial cut-away.

Referring to FIG. 2, the vacuum unit 205 has a suction motor 276 (a combination of a motor and an impeller, not separately shown) within a motor housing 221 (typically an upper portion of the vacuum unit 205). Extending from the motor housing 221 is a receptacle 223 (typically a lower portion of the vacuum unit 205) for receiving dirt 277.

The vacuum unit 205, driven by the suction motor 276, generates a vacuum to create air flow in a cleaning air path through the vacuum unit 205 as illustrated by arrows 270. Cleaning air is distinct from motor cooling air. A motor cooling air path, not shown, is typically also provided within the vacuum unit 205 to provide cooling air to the motor 276. Incoming motor cooling air is drawn from the environment around the vacuum unit 205. The vacuum unit 205 can mix exhaust cleaning air and motor cooling air together or, alternatively, motor cooling air and cleaning air can be exhausted separately. For the purposes of this description the cleaning air path is that portion of an air path that contains cleaning air whether or not the air flow path also contains motor cooling air.

The cleaning air is divided from dirt 277 within the vacuum unit 205. For example, the vacuum unit 205 can provide a coarse dust separator 280 followed by a finer filter 278 in the cleaning air path 270 within the vacuum unit 205 over the dirt receptacle 223 and prior to motor 276. When cleaning air ceases to flow in the cleaning air path 270, for example because the vacuum unit 205 has been turned off, the dirt 277 falls from the dust separator 280 and filter 278 into the dirt receptacle 223 to the extent the dirt 277 have not already fallen into the dirt receptacle 223. Filtering the dirt 277 can assist in reducing wear on the motor 276. Other methods of dividing dirt from cleaning air into a dirt receptacle are known in the central vacuum cleaning system art. The methods and systems described herein are applicable to such methods of dividing dirt from cleaning air within a central vacuum cleaning system vacuum unit.

That part of the cleaning air path 270 prior to the vacuum unit 205 contains dirty cleaning air and is a dirty cleaning air path. That part of the cleaning air path 270 after the vacuum unit 205 contains cleaning air exhausted from the motor 276 and is an exhaust cleaning air path.

The vacuum unit 205 has an inlet port 272 through which dirty cleaning air is received and an exhaust port 274 through which exhaust cleaning air is exhausted. The inlet port 272 can be a piping port such that inlet port 272 is dimensioned to receive piping 207. The exhaust port 274 can similarly be a piping port such that exhaust port 274 is dimensioned to receive piping 207. Typically, for residential uses central vacuum cleaner piping is tubular PVC conduit of approximately two inch internal diameter. Other sizes and materials may be used.

The control unit 3 is mounted outside the vacuum unit 205. The control unit 3 is mounted in the cleaning air path 270 in air flow communication with all inlet valves 209. Air flow communication to all inlet valves 209 requires that the control unit 3 be located in the cleaning air flow path 270 such that when the vacuum unit 205 is drawing suction then air flows through the control unit 3 from any inlet valve 209 in use. Thus, the control unit 3 is between the vacuum unit 205 and a first branching 280 of the piping 7 between two inlet valves 209.

The control unit 3 is preferably located adjacent the vacuum unit 205 such that the control unit 3 can be electrically connected to a motor power input 500 of the vacuum unit 205 to control the provision of power for the motor 276. Typically a motor power input 500 of the vacuum unit 205 is provided by way of a power cord 502 terminating in a male plug 504 that would otherwise be connected to mains power 7, for example through an electrical receptacle 506. The motor power input 500 is connected to the control unit 3 rather than the receptacle 506. The main power 7 is typically line voltage, for example, 120V or 240V, 60 Hz AC in North America or 230V, 50 Hz AC in Europe.

Further, the control unit 3 can be located in the same space as the vacuum unit 205 such that the control unit 3 is accessible when installing and maintaining the vacuum unit 205.

Figure 3:
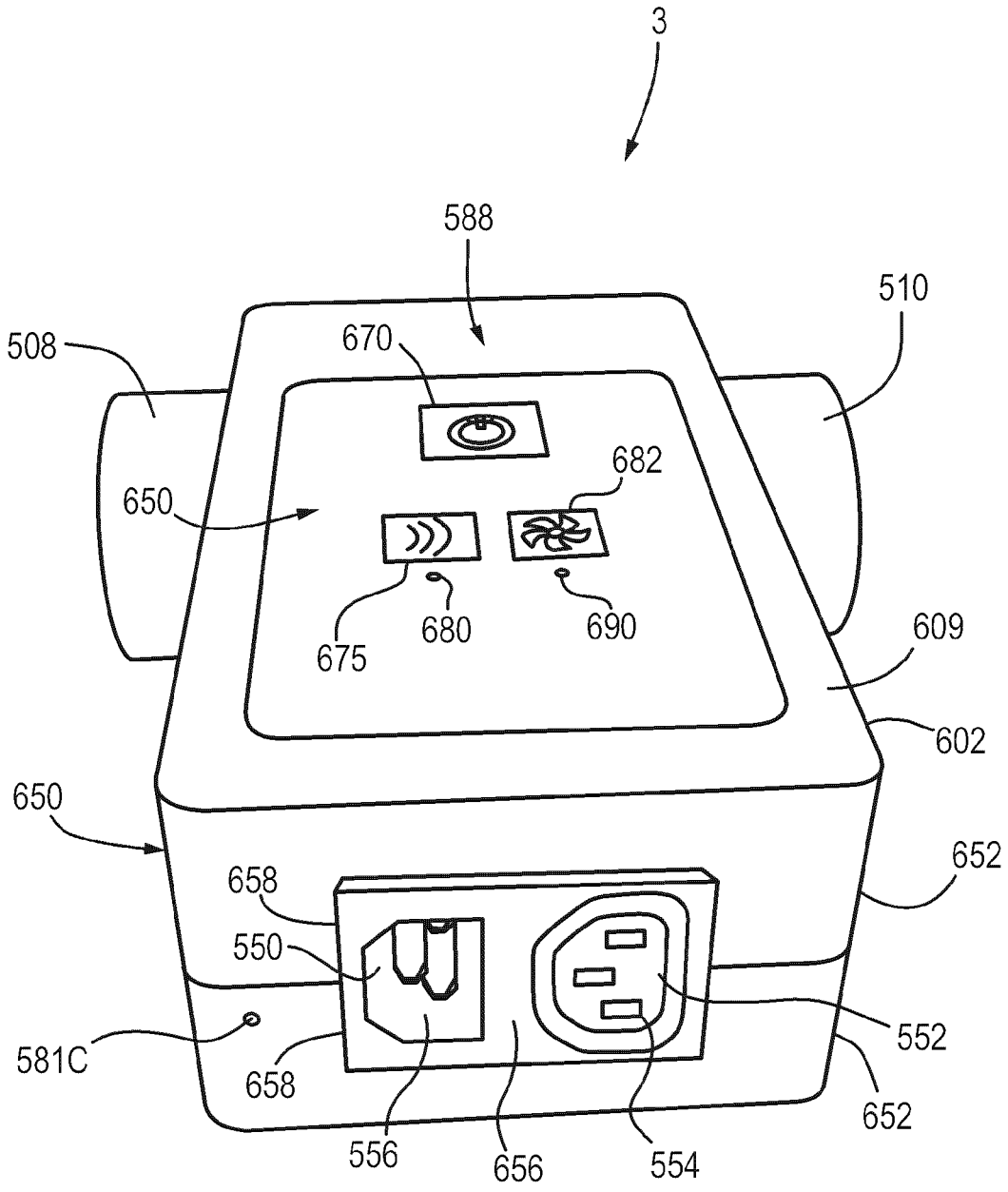
FIG. 3 is perspective view of the control unit of FIG. 2.

Referring to FIGS. 2 and 3, the control unit 3 includes opposing ports 508, 510 at either end of a conduit 512 such that the control unit 3 can be connected to the cleaning air path 270 at the ports 508, 510 and through the conduit 512 to form part of the cleaning air path 270. As shown in the FIGS. the ports 508, 510 are piping ports that are dimensioned to receive central vacuum cleaning system piping 207.

The location of the control unit 3 between portions of piping in the central vacuum cleaner system 201 can considerably ease installation, particularly in retrofit applications. The piping 207 can be cut to create two opposing piping ends, the control unit 3 is then simply inserted between and attached at the ports 508, 510 to the created piping ends. Pre-existing motor control circuitry within the vacuum unit 205 can be removed or bypassed. As an example bypass, if the vacuum unit 205 has existing wired communication control circuitry with a relay module, not shown, then existing low voltage control wire connections to the vacuum unit 205 can be shorted (equivalent to an "ON" signal).

Due to the operation of relays it may be required to operate initially at full power in order to turn on the relay. Accordingly, when an "ON" signal is received by the control unit 3 then full power is provided by the control unit 3 to the vacuum unit 205 from the source of mains power, receptacle 506. It has been found that three AC cycles is typically enough time to turn the relay on. Any motor soft start routine in the control unit 3 can then be run by first dropping the voltage, followed by slowly ramping up to full voltage.

Although not shown in the FIGS., one of the ports 508 or 510 can be formed together with a port 272 or 274 of the vacuum unit 205 such that piping 207 is not required between the vacuum unit 205 and the control unit 3.

Referring to FIG. 3, the control unit 3 has a power input 550 and a power output 552. The power output 552 can be electrically connected to the motor power input 500. The power output 552 can be an electrical receptacle 554 such as a female receptacle 554 to receive prongs of the plug 504. Other structures to electrically connect the motor power input 500 and the power output 552 will be evident to those skilled in the art, such as for example direct wiring from the vacuum unit 205 to the control unit 3.

The power input 550 can be electrically connected to a source of mains power, such as for example receptacle 506. The power input 550 can be an electrical receptacle 556 such as a male receptacle 556 to receive a female end of a male/female cord, not shown, for connection from the receptacle 556 to the receptacle 506. Other structures to electrically connect the power input 550 to mains power will be evident to those skilled in the art, such as for example a cord wired to the control unit 3.

Figure 4:
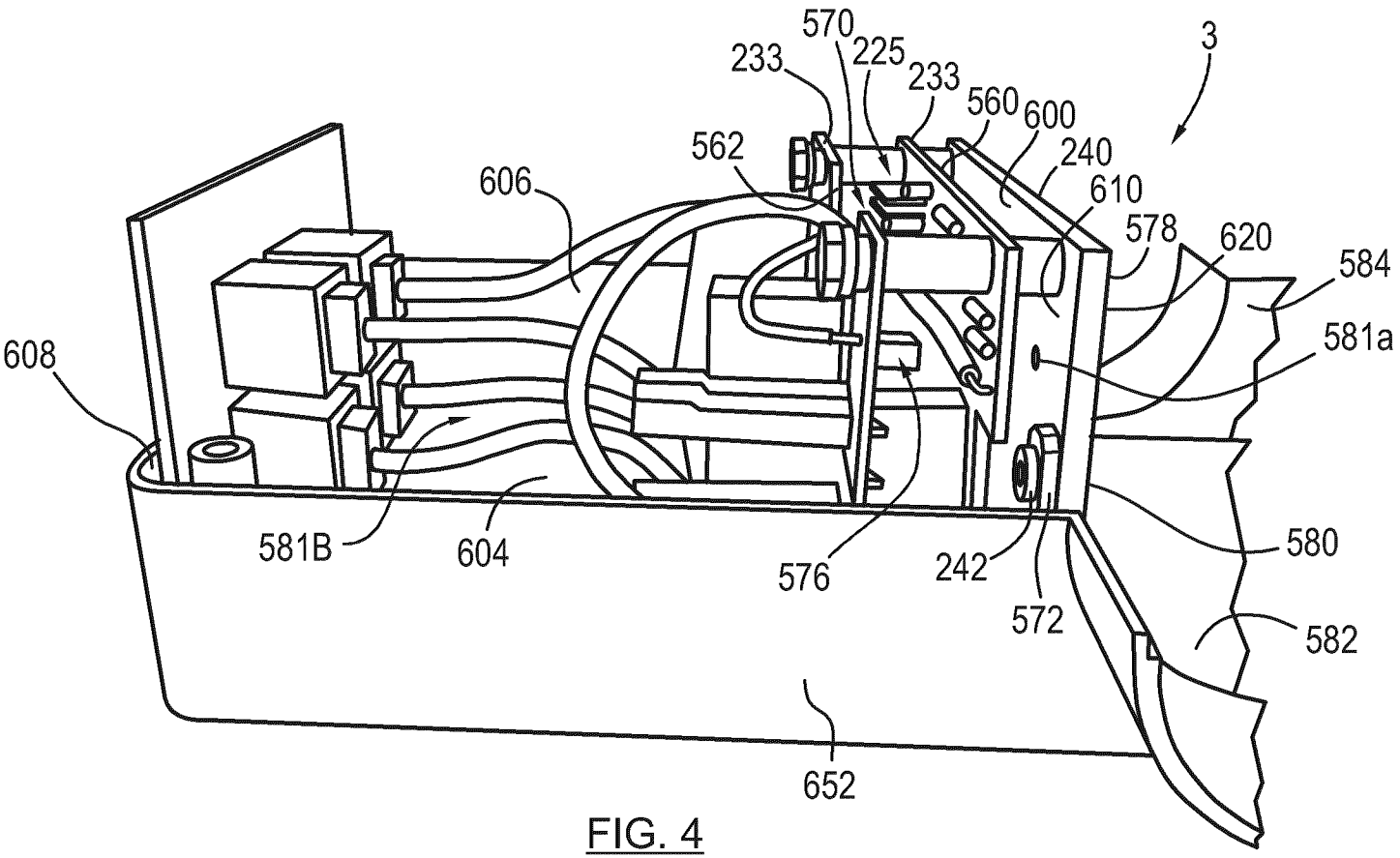
FIG. 4 is a perspective cut-away view from one side and slightly in front of the control unit of FIG. 2.

Referring to FIG. 4, the control unit 3 includes motor control circuitry 225. As described later below, the control unit has two covers 652. For clarity, one cover has been removed from the control unit 3 and is not shown in FIG. 4. The motor control circuit 225 can be laid out on one or more printed circuit boards 233, including all of the components (indicated generally at 570) to implement the functions of the control unit 3. Multiple printed circuit boards or separately mounted components may be used as desired. In FIG. 4, two printed circuit boards 233 are stacked one on top of the other. For example, one board 560 can provide some control functions, while another board 562 provides electromagnetic interference (EMI) suppression circuitry.

The motor control circuitry 225 includes one or more components, such as component 572, that generate heat. Heat generated by the circuitry 225 can affect the proper operation of the circuitry 225, including for example component 572. A heat sink 240 is provided to assist in cooling the circuitry 225. One or more components 570, such as component 572, are placed in thermal contact with the heat sink 240 to provide a thermal conduction path to conduct heat away from the circuitry 570, and in particular from the component 572. Thermal contact can be achieved by placing one or more components 570, such as component 572, in physical contact with the heat sink 240. Thermal conduction paste can be used to assist in conducting heat between the component 570 and the heat sink. The component can be attached to the heat sink to prevent movement between the component 570 and the heat sink 240. Alternative methods can be used to fix a component 570 to the heat 240 and providing thermal conduction, for example, by soldering or applying a thermally conductive glue.

As an example the component 572 can be a triac to control the supply of power from the power input 550 to the power output 552, and, thus, control the supply of power from the receptacle 506 to the vacuum unit 205. The component 572 can be placed in physical contact with the heat sink 240 and fixed to the heat sink 240 using a screw 242.

Although a printed circuit board embodiment is shown in the FIGS. it is recognized that all or part of the motor control circuitry 225 can be provided in dependently of a circuit board. For example, the component 572 can be fixed to the heat sink and electrically connected by wires, not shown, to the remainder of the circuitry 225 on a printed circuit board.

The motor control circuitry 225 includes a communication module 576 within the components 570 to receive control signals from a remote control unit. In the example provided in the FIGS. the communication module 576 is a wireless communication module for receiving control signals from a remote control unit, such as handle 213 incorporating user interface 218 and a wireless communication module similar to the communication module 576. Alternatively, the communication module 576 can receive control signals from a wired connection. In this case, control inputs, not shown, can be provided on the control unit 3, such control inputs to be connected to control wires between the control unit 3 and the handle 213. Many examples of motor control circuitry including communication between a handle and a vacuum unit are known in the art, see for example, U.S. Pat. No. 7,403,360 issued Jul. 22, 2008 to J. Vern Cunningham which describes both wired and wireless communication in central vacuum cleaning systems.

The control unit 3 can also communicate with other devices, not shown, such as a remote station or other appliances. An example of wireless communication between a central vacuum cleaning system communication module and a remote station is described in the above US patent. An example of wireless communication between a central vacuum cleaning system communication module and other appliances is described in US Patent Publication Number 2007/0079467 A1 of J. Vern Cunningham published Apr. 12, 2007.

The heat sink 240 forms a surface 578 of the conduit 512 such that the heat sink 240 is in thermal contact with the cleaning air path 270. Air flow in the cleaning air path 270 during operation of the system 201 when the suction motor 276 is running will carry heat away from the heat sink 240 to cool the component 572.

For additional cooling a small aperture 581*a* could be provided in the heat sink 240 to connect housing chamber 581*b* inside the housing 602 to the cleaning air path 270 within the conduit 512. The aperture 581*a* acts as a venturi when air is flowing in the cleaning air path 270 during operation of the system 201 such that air is drawn from the chamber 581*b* into the conduit 512 and the cleaning air path 270. If the housing chamber 581*b* is tightly sealed a further aperture 581*c* (see FIG. 3) can be provided to allow air to be drawn into the chamber 581*b* from the surrounding environment as air is drawn from the chamber 581*b* through the aperture 581*a*.

As shown in FIG. 4, the heat sink 240 forms part of a lower wall 580 of the conduit 512. Other surfaces of the conduit 512 include rear wall 582, side walls 584, top wall 586, and front wall 588, not shown in FIG. 4 but the back of the front wall 588 is evident in FIG. 3.

The heat sink also forms a surface of an upper wall 600 of a motor control housing 602. Other surfaces of the housing 602 include rear wall 604, side walls 606, bottom wall 608, and front wall 609, not shown in FIG. 4 but the back of front wall 609 is evident in FIG. 3. The motor control circuitry 225 is housed by the motor control housing 602.

As shown in the FIGS. the heat sink 240 has a flat planar surface 610 forming the upper wall 600. This is advantageous as circuitry 225 that requires heat sinking is often provided in the form of an integrated circuit package have a flat planar thermal contact surface. Also, the heat sink 240 can be easily manufactured from a piece of sheet material, such as an aluminum sheet. Other thermally conductive materials can be used for the heat sink.

Surface 620 of the heat sink 240 is a flat plane surface. The surface 620 is in contact with the cleaning air path 270 at a radius from a longitudinal axis of the conduit 512 that is equal to or greater than the radius of the cleaning air path 270 outside and adjacent the control unit 205 (typically the diameter of piping 207) to provide sufficient thermal contact and avoid reducing air flow within the cleaning air path 270.

The conduit 512 has a cuboid shape to accommodate the heat sink 240 and for ease of manufacturing. It is recognized that the conduit 512 can take alternate shapes. For example, the conduit 512 could have a combination of curved surfaces and flat plane surfaces, such as a tube bisected, in half or otherwise, by a flat plane parallel to the longitudinal axis of the tube and completed by a flat plane surface 620 of the heat sink 240. The tube could be bisected along the length of the conduit 512, or only in part such that the heat sink is inserted into an opening in the tube. As a further example, the entire conduit 512 could be tubular with the surface 620 being a curved plane forming a curved surface of the tubular conduit. A tubular conduit heat sink embodiment is described later with reference to FIGS. 6 and 7. Use of a partial tubular conduit can require an increase of the radius of the tube to provide sufficient thermal contact while avoiding reduction in air flow within the cleaning air path 270.

Referring to FIG. 3, the conduit 512, ports 508, 510 and motor control housing 602 are provided by a unitary vacuum control unit housing 650. For ease of manufacture and assembly, the housing 650 is made up of two opposing housing covers 652 and a receptacle plate 656. An opening 658 is provided in each cover through which the receptacle plate 656 is accessible. The receptacle plate 656 includes the receptacles 554, 556.

The control unit 3 includes a user interface 650. The user interface 650 is provided on the exterior of the housing 602. The user interface 650 can receive user input and provide information regarding the status of the system 201. For example, a power user input 670 receives user input to turn on or off the control unit 3. Upon receipt of user input the power user input 670 is part of the motor control circuitry 225 and the power user input 670 signals the control unit 3 to turn the control unit 3 on or off. When the control unit 3 is "on" the control unit 3 is ready to provide power to the vacuum unit 205 in accordance with control signals received by the control unit 3.

As a further example, the user interface 650 can include a pairing user input 675 to activate a pairing sequence between the communication module 576 and a corresponding communication module, such as a communication module at the handle 213 as described earlier herein. Known methods for pairing wireless devices can be used and will not be described further herein. A pairing indicator 680, such as an LED, can indicate commencement of a pairing sequence, for example by flashing, and successful pairing, for example by illuminating continuously.

As yet another example, the user interface 650 can include a motor parameter setting sequence user input 682 to initiate detection and storage of motor running parameters by the control circuitry 225. The sequence can be referred to as a "learn mode". A learn mode indicator 690 can be provided to indicate the status of the learn mode sequence. An example of parameters to be detected and stored during learn mode is described in U.S. Pat. No. 7,403,360 of J. Vern Cunningham issued Jul. 22, 2008.

Referring to FIG. 4, the heat sink 240 is mounted to the housing 602 and to the conduit 512.

Figure 5:
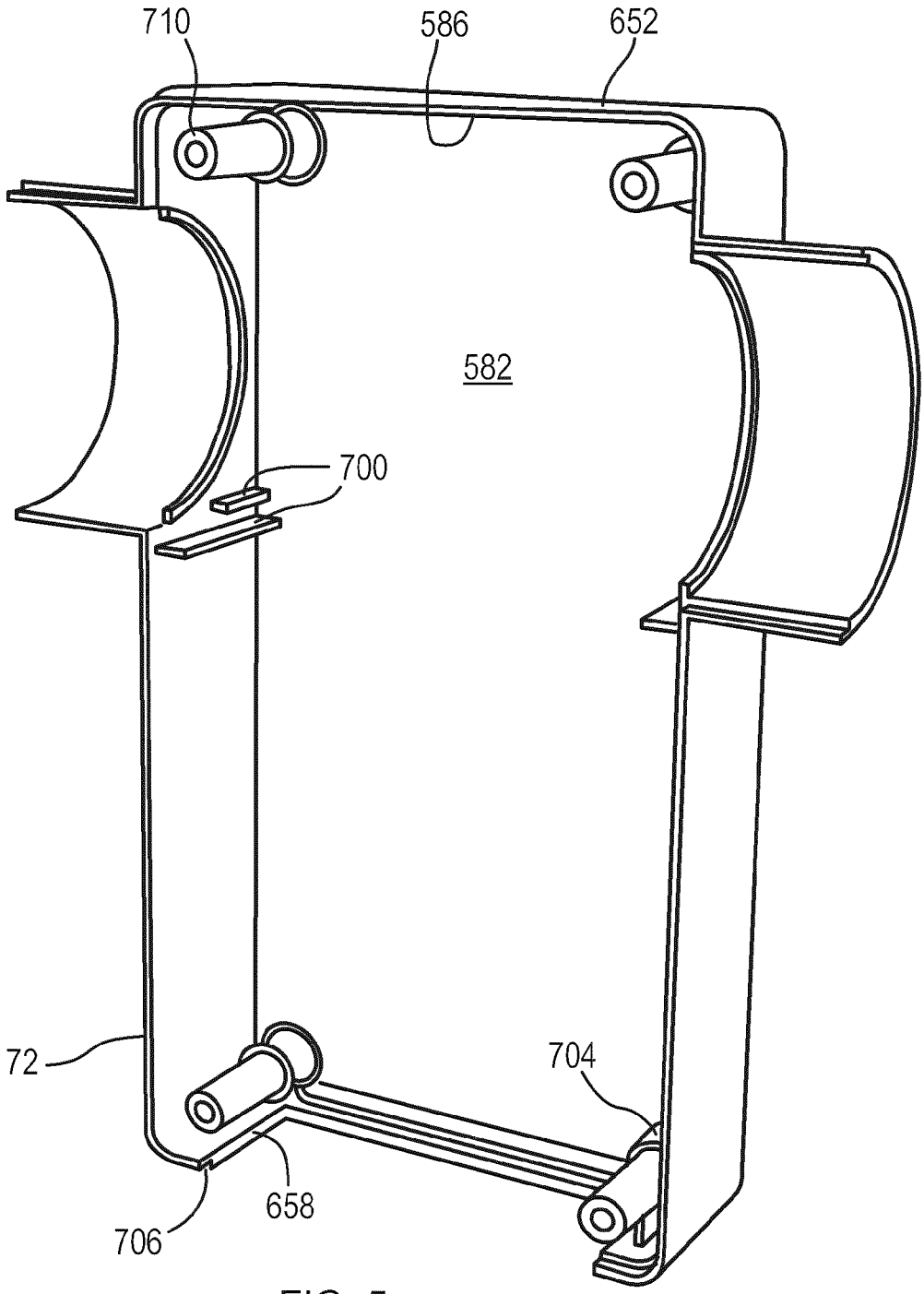
FIG. 5 is a perspective cut-away view from above, to one side, and slightly above an example implementation of a control unit housing for the control unit of FIG. 2.

Referring to FIG. 5, each cover 652 has mounting brackets 700 to receive and retain the heat sink 240 in place. The heat sink 240 is retained by the mounting brackets 700 from movement perpendicular to the plane of the heat sink 240 and by the cover walls from movement parallel to the plane of the heat sink 240.

Each cover 652 has opposing overlaps 702, 704 about an edge 706. The overlaps 702, 704 are indented asymmetrically on each cover 652 such that the covers 652 can be identical. This can reduce manufacturing costs.

Hole bosses 710 are spaced about each cover 652 to allow for bolts, not shown, to be used to attach the covers 652. Alternative methods can be used to attach the covers 652, such as for example screws, glue, interlocking tabs or a press fit. It is recognized that alternative cover designs are possible. It is also recognized that the control unit 3 can be formed without a housing 650 having a unitary construction.

Figure 6:
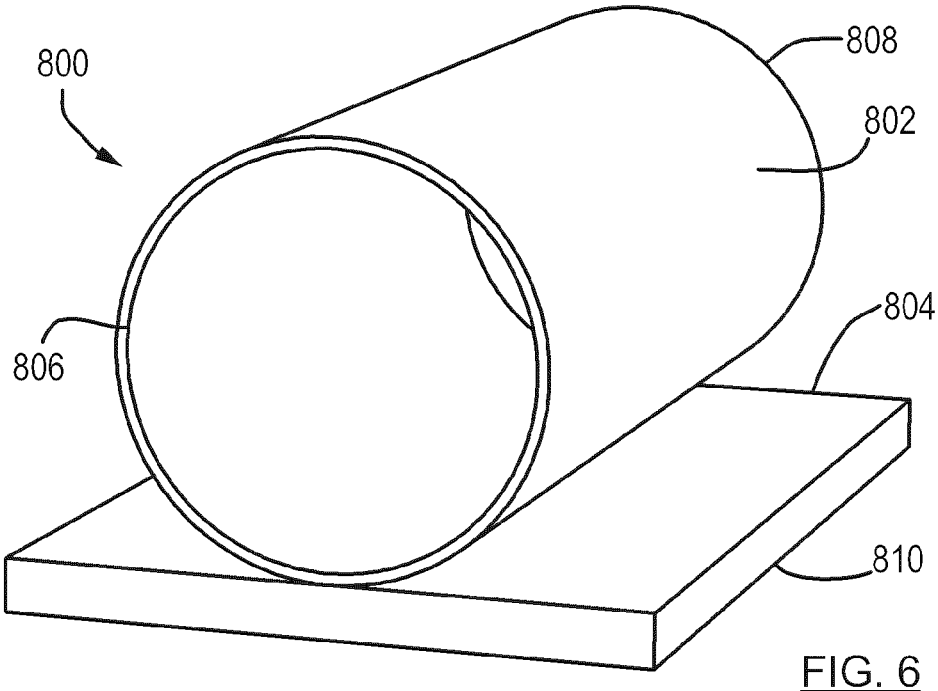
FIG. 6 is a perspective view of an example alternative conduit heat sink for use in an example alternative implementation of a control unit for the system of FIG. 1.

Referring to FIG. 6, a combined ported conduit heat sink 800 could be formed from thermally conductive material. The combined conduit heat sink 800 has a conduit 802 and a component mount 804. Opposing open ends of the conduit 802 provide ports 806, 808. The conduit and mount 804 together form the heat sink 800. The mounting portion 804 provides a flat planar surface 810 to which the component 572 may be mounted. When the heat sink 800 is connected in the cleaning air path 270 at the ports 806, 808 the heat sink 800 is in thermal contact with the cleaning air path 270.

Figure 7:
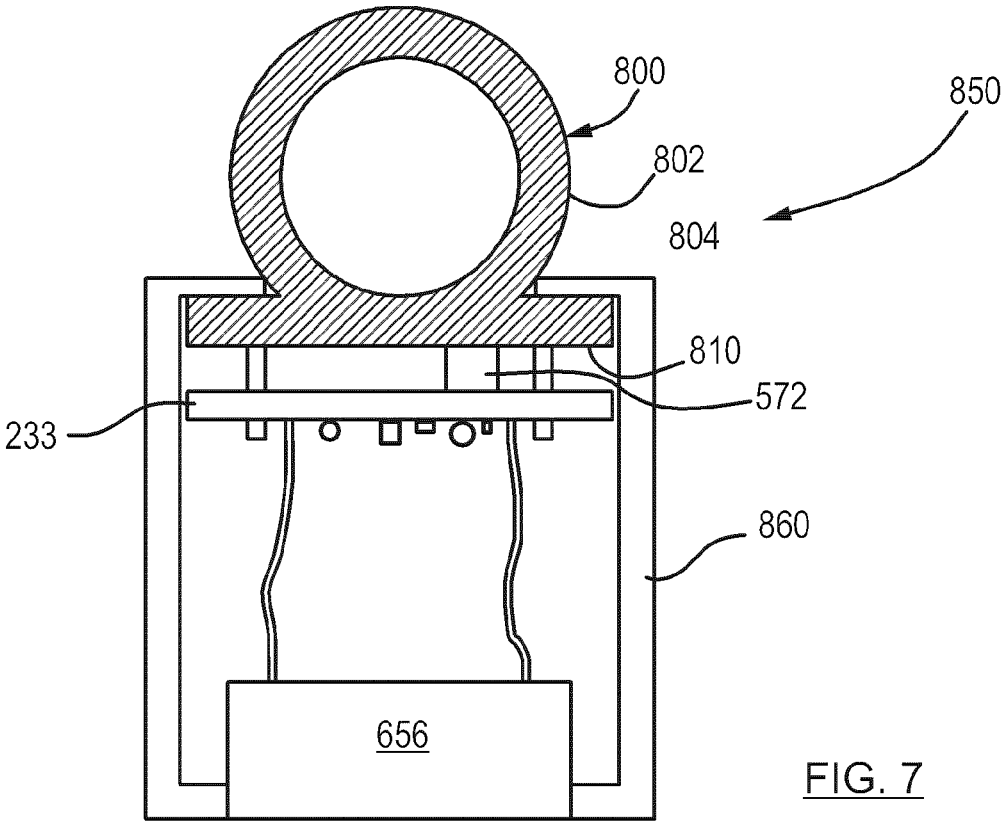
FIG. 7 is a cross-section of an example alternative control unit employing the heat sink of FIG. 6.
Figure 8:
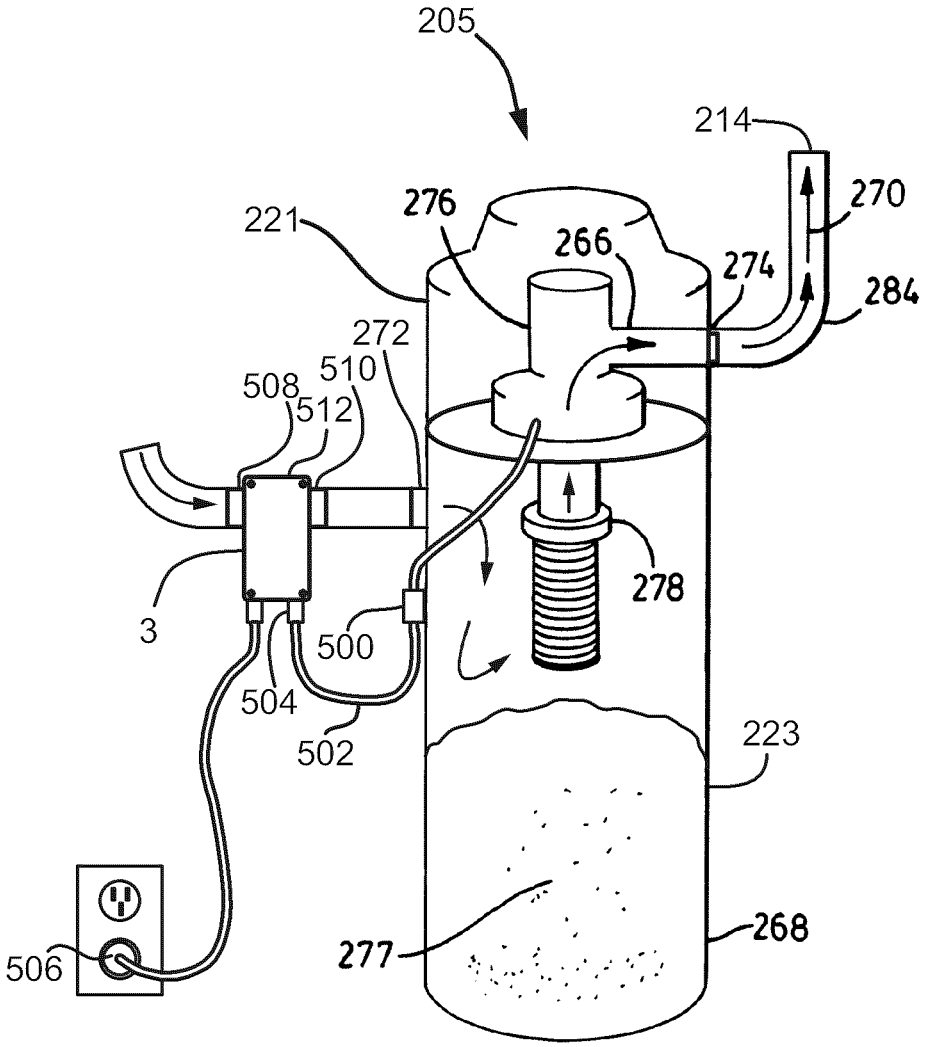
FIG. 8 is a perspective view of an example implementation of a vacuum unit and control unit assembly similar to the assembly of FIG. 2, but with the control unit in a dirty air path.

Referring to FIG. 7, a control unit 850 utilizes the heat sink 800. Component 572 is mounted to the mount 804. Additionally, board 233 is mounted to the mount 804. A housing 860 is mounted to the mount and encloses the circuitry 225, and receptacle plate 656.

The mount 804 can be of a smaller size sufficient to provide thermal conduction from the component 572. The housing 860 can attach to the mount 804 or can attach to other elements of the control unit 3 or the system 201. For example, the housing 860 can attach to the conduit 802.

Other embodiments and aspects will be evident from the detailed description and drawings hereof. For example, such aspects may include alternative combinations of the elements of the aspects set out above, and combinations that include fewer or more elements in combination with other elements from the detailed description, or combinations that are drawn from the detailed description alone.

It will be understood by those skilled in the art that this description is made with reference to the preferred embodiments thereof and that it is possible to make other embodiments employing the principles of the invention which fall within its spirit and scope as defined by the following claims.

We claim:

1. A central vacuum cleaning system comprising:

a vacuum unit, a plurality of inlet valves, an exhaust, a cleaning air path from the inlet valves through the vacuum unit to the exhaust, a control unit comprising:

a power input, a power output, motor control circuitry to control application of power from the power input to the power output, a first port, a second port, a conduit providing a conduit air path between the first port and the second, a heat sink in thermal contact with the conduit air path and a component of the motor control circuitry, wherein the control unit is connected through the first port and the second port in the cleaning air flow path between one of the plurality of inlet valves and the exhaust, and the power output is connected to a power input of the vacuum unit.

2. The system of claim 1 wherein the control unit is connected in the cleaning air path between the vacuum unit and the inlet valves in air flow communication with all inlet valves.

3. The system of claim 1 wherein the control unit is connected in the cleaning air path between the vacuum unit and the exhaust.

4. The system of claim 1 further comprising central vacuum cleaning system piping between the inlet valves and the vacuum unit, and between the vacuum unit and the exhaust, wherein the piping provides a portion of the cleaning air path, and the first port and second port are piping ports connected to the piping.

5. The system of claim 1 wherein the heat sink forms a surface of the conduit in the conduit air path.

6. The system of claim 1 further comprising a motor control housing that houses the motor control circuitry, and wherein the heat sink forms a surface of the motor control housing.

7. The system of claim 1 further comprising a motor control housing that houses the motor control circuitry, and wherein the heat sink is mounted to the housing and to the conduit.

8. The system of claim 7 further comprising a small aperture connecting the housing and the conduit air path.

9. A central vacuum cleaning system control unit for installation in a central vacuum cleaning system having a vacuum unit, a plurality of inlet valves, an exhaust, and a cleaning air path from the inlet valves through the vacuum unit to the exhaust, the control unit comprising:

a power input, a power output, motor control circuitry to control application of power from the power input to the power output, a first port, a second port, conduit providing at least part of the cleaning air path between the first port and the second, and a heat sink in thermal contact with the cleaning air path and a component of the motor control circuitry.

10. The control unit of claim 9, wherein the first port and the second port are piping ports to connect to central vacuum cleaning system piping in the system.

11. The control unit of claim 9 wherein the heat sink forms a surface of the conduit in the conduit air path.

12. The control unit of claim 9 further comprising a motor control housing that houses the motor control circuitry, and wherein the heat sink forms a surface of the motor control housing.

13. The control unit of claim 12 further comprising a small aperture connecting the housing and the conduit air path.

14. The control unit of claim 9 further comprising a motor control housing that houses the motor control circuitry, and wherein the heat sink is mounted to the housing and to the conduit.

15. A method of cooling motor control circuitry in a central vacuum cleaning system, the method comprising:

generating a vacuum to create air flow in a cleaning air path from one of a plurality of inlet valves through a vacuum unit to an exhaust, wherein the cleaning air path includes a conduit air path of a control unit connected between one of the plurality of inlet valves and the exhaust and the control unit comprising a power input, a power output, motor control circuitry to control application of power from the power input to the power output, a first port, a second port, a conduit providing the conduit air path between the first port and the second port, and a heat sink in thermal contact with the conduit air path and a component of the motor control circuitry.

16. The method of claim 15 wherein the conduit air path of the control unit is connected in the cleaning air path between the vacuum unit and the inlet valves in air flow communication with all inlet valves.

17. The method of claim 15 wherein the conduit air path of the control unit is connected in the cleaning air path between the vacuum unit and the exhaust.

18. The method of claim 15 wherein the central vacuum cleaning system includes piping between the inlet valves and the vacuum unit, and between the vacuum unit and the exhaust, and the piping provides a portion of the cleaning air path, and the first port and second port are piping ports connected to the piping.

* * * * *